United States Patent [19]

Bingisser

[11] Patent Number: 4,484,741

[45] Date of Patent: Nov. 27, 1984

[54] EXERCISING APPARATUS

[76] Inventor: Josef Bingisser, 3121 W. 6th Ave., Vancouver, British Columbia, Canada

[21] Appl. No.: 515,129

[22] Filed: Jul. 19, 1983

[51] Int. Cl.[3] ..... A63B 21/22

[52] U.S. Cl. ..... 272/131; 272/132; 272/140

[58] Field of Search ..... 272/116–117, 272/126, 130–132, 142–143, 138, 140; 242/107.3, 99, 107; 192/12 R, 12 A, 12 B, 41 R; 254/364

[56] References Cited

U.S. PATENT DOCUMENTS

| | | | |
|---|---|---|---|
| 518,967 | 5/1894 | Poole | 272/132 |
| 2,725,231 | 11/1955 | Hoover | 272/130 X |
| 3,211,453 | 10/1965 | Williams | 272/131 X |
| 3,995,853 | 12/1976 | Deluty | 272/132 |
| 4,174,832 | 11/1979 | Thompson | 272/140 X |

FOREIGN PATENT DOCUMENTS

| | | | |
|---|---|---|---|
| 2274322 | 2/1976 | France | 272/132 |

*Primary Examiner*—Richard J. Apley
*Assistant Examiner*—Chris Coppens
*Attorney, Agent, or Firm*—Carver & Co.

[57] ABSTRACT

An exercising apparatus has a hollow housing with an aperture extending therethrough and a cavity on one side. The cavity has a cylindrical portion and at least one slot portion extending outwardly at the edge of the cylindrical portion. A first handle is connected to the housing. An axle, with a round portion and a square portion, extends rotatably through the aperture. A bolt extends through a longitudinal aperture through the axle. The round portion of the axle extends through a pulley wheel in the hollow housing. There is a one way clutch between the pulley wheel and the round portion of the axle. A strap, normally wound about the pulley, wheel extends from an opening in the housing. A spiral spring within the housing biases the pulley wheel to wind the strap. There is a set of at least three friction discs proportioned to fit freely and removably within the cavity of the housing. A rotatable metal disc has a square central aperture for rotation with the square portion of the axle. A non-rotatable metal disc has a round central aperture and an outwardly extending projection shaped to fit within the slot portion of the cavity. A leather disc between the metal discs has a round central aperture. There is a knob threaded onto the bolt to compress the friction discs between the knob and the housing. The knob is removable to permit the set of friction discs to be replaced.

7 Claims, 4 Drawing Figures

EXERCISING APPARATUS

BACKGROUND OF THE INVENTION

1. Field of the Invention

This invention relates to an exercising apparatus including a housing with a plurality of friction discs and a pulley wheel wound with a strap and resiliently biased to the wound position.

2. Prior Art

Devices of the general class have been developed in the past which include a housing, a resiliently biased pulley wheel wound with a strap, friction discs for resisting rotation of the pulley wheel and unwinding of the strap, handle means on the housing and another handle means connected to the strap. For example, a device of this type shown is shown in U.S. Pat. No. 3,995,853 to Deluty. Other devices of the general type are shown in U.S. Pat. No. 518,967 to Poole and U.S. Pat. No. 3,103,357 to Bern.

Previous devices of this class have offered certain disadvantages or features which have limited their usefulness or popularity. For example, referring to the Deluty patent, the friction discs are located within the housing so the device would have to be disassembled to replace the discs. This is disadvantageous because it would be desirable to permit quick replacement of a set of discs with another set of discs capable of exerting an appreciatably different frictional force. For example, an apparatus owned by a family could have one set of discs which exert a stronger force for a man and another set with a much weaker force for children. While these devices do normally permit some adjustment of the frictional force, replacing the entire set of discs would offer a much greater potential range of forces. In addition, sometimes the friction discs become contaminated and lose their proper frictional properties. It would be desirable to quickly change these discs but this would not be possible with the Deluty device.

SUMMARY OF THE INVENTION

According to the invention, an exercising apparatus comprises a hollow housing having an aperture extending therethrough and a cavity on one side. The cavity has a cylindrical central portion, the aperture communicating with the center of the cylindrical portion, and at least one slot portion extending outwardly at the edge of the central portion. A first handle means is connected to the housing. An axle extends rotatably through the aperture and the housing, the axle having a first portion which is round in section, a second portion extending through the cavity which is square in section, and a longitudinal central aperture. Bolt means extends through the aperture of the axle and has a threaded portion extending axially from the second portion. A pulley wheel within the hollow housing has a central aperture. The first portion of the axle extends through the aperture of the pulley wheel. There is one way clutch means between the pulley wheel and the first portion of the axle. The one way clutch permits free rotation of the pulley wheel in a first direction of rotation and locks the pulley wheel to rotate with the axle in a second direction of rotation which is opposite the first direction. There is strap means connected to, and normally wound about, the pulley wheel having a free end extending from an opening in the housing. A spiral spring within the hollow housing is connected to the housing and the pulley wheel to bias the pulley wheel in the first direction of rotation to wind the strap means on the pulley wheel. A set of at least three adjacent friction discs is proportioned to fit freely and removably within the cavity of the housing. A first non-rotatable metal disc has an outwardly extending projection shaped to fit within the slot portion of the cavity. A rotatable metal disc with a square central aperture receives the second portion of the axle so the center disc rotates with the axle. There is a first leather disc between the metal discs. The leather disc and the non-rotatable disc each has a circular central aperture permitting rotation between said each disc and the axle. There is knob means having a threaded aperture for threading the knob means onto the bolt means. The friction discs are pressed together within the cavity between the knob means and the housing when the knob means is tightened on the bolt means. The knob means is removable from the bolt means to permit replacement of the set of friction discs.

DESCRIPTION OF THE PREFERRED EMBODIMENTS

Figure 1:
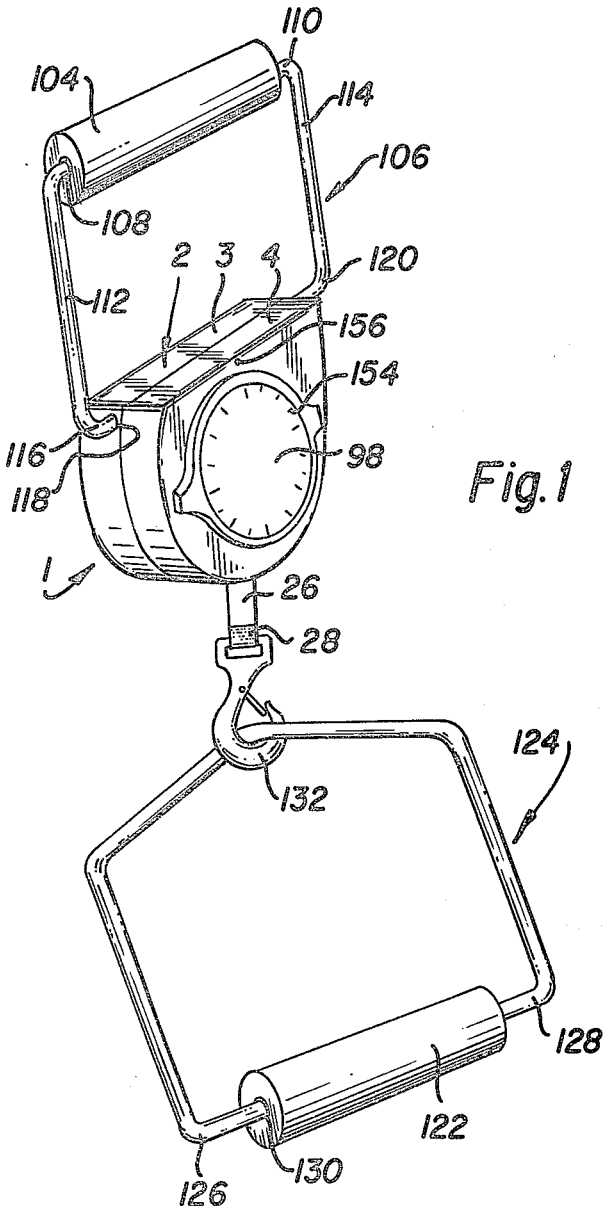
FIG. 1 is an isometric view of an exercising apparatus according to an embodiment of the invention.
Figure 2:
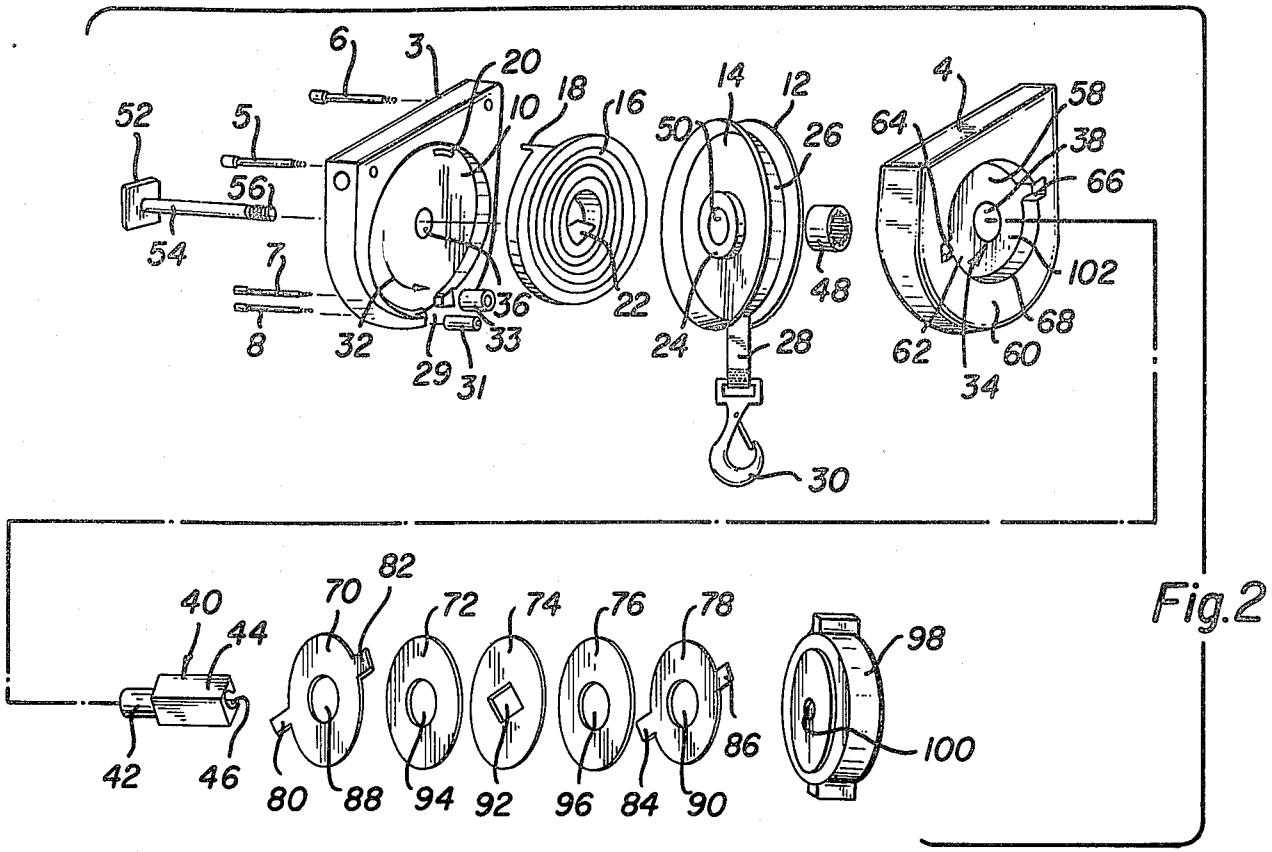
FIG. 2 is an exploded perspective view thereof.

FIG. 1 shows an exercising apparatus 1 according to the invention in assembled form. The apparatus includes a housing 2 which can be made of plastic or metal for example. The housing is formed by two halves 3 and 4 which are held together by bolts 5, 6, 7 and 8 shown in the exploded view of FIG. 2. The housing is hollow having an interior cavity 10 formed in housing half 3 between housing half 3 and housing half 4. A pulley wheel 12, slightly smaller in diameter than cavity 10, is rotatably received within the cavity. A cylindrical recess 14 is formed in the side of pulley wheel 12 facing housing half 3. A spiral spring 16 fits within recess 14 when the pulley wheel is in interior cavity 10. A laterally projecting tab 18 on the spiral spring fits within a slot 20 in housing half 3 to connect the spiral spring to the housing. A radially extending tab 22 near the center of the sprial spring fits within a slit 24 in the pulley wheel to connect the spiral spring to the pulley wheel.

A strap 26, made of nylon webbing or similar strong material, is wound on the pulley wheel. The inner end of the strap is connected to the pulley wheel, while the outer free end 28 is connected to a safety-type hook connector 30. Free end 28 extends through a slot 29 in the housing between rollers 31 and 33 which are rotatably mounted on bolts 8 and 7. The spiral spring 16 is wound in a direction to bias the pulley wheel in a first direction indicated by the arrow 32 in FIG. 2 such as to wind the strap onto the pulley.

The housing has an aperture extending therethrough shown generally at 34. Aperture 34 consists of a first aperture portion 36 in housing half 3 and a second aperture portion 38 in housing half 4. An axle 40 extends rotatably through the center of the housing. The axle has a first portion 42 which is round in section and a second portion 44 which is square in section. The axle also has a longitudinal central aperture 46. The first portion 42 extends between housing halves 3 and 4. A cam lock 48 is fitted over first portion 42, providing one way clutch means. The cam lock freely rotates on axle portion 42 in the first direction indicated by arrow 32. However, in the conventional manner, the cam lock locks onto the axle in a second direction of rotation which is opposite the direction indicated by arrow 32. The cam lock 48 is fitted tightly and non-rotatably within central aperture 50 of the pulley wheel. Thus, the cam lock permits free rotation of the pulley wheel about the axle in the first direction of rotation shown by arrow 32, but locks the pulley wheel to the axle in the opposite direction of rotation.

There is a bolt 52 having a shaft 54 extending through aperture 36 in housing half 3 and rotatably through central aperture 46 of axle 40. A threaded outer portion 56 of the bolt extends axially outwards from the second portion 44 of the axle.

The second portion 44 of the axle, which is square in section, projects into a cavity 58 extending inwardly from side 60 of housing half 4. The cavity has a central portion 62 which is cylindrical in shape. In addition, the cavity has a pair of slot portions 64 and 66 which extend radially outwards from the edge 68 of the central portion.

The apparatus has a set of five adjacent friction discs 70–78 inclusive. The set is proportioned to fit freely and removably within the cavity 58. The non-rotatable, outer discs 70 and 78 are of metal. Disc 70 has a pair of outwardly extending projections 80 and 82 shaped to fit within slot portions 64 and 66 of cavity 58. Disc 78 has corresponding projections 84 and 86. Disc 70 has a central aperture 88 large enough to permit free rotation of square axle portion 44 within the aperture. Disc 78 has a similar sized circular central aperture 90.

The rotatable center disc 74 is also of metal, but has no projections for fitting within slot portions 64 and 66. In addition, disc 74 has a square central aperture 92 shaped to fit over the square second portion 44 of the axle. The remaining pair of discs 72 and 76 are of leather. Disc 72 fits between outer disc 70 and center disc 74, while leather disc 76 fits between outer disc 78 and center disc 74. Disc 72 has a circular aperture 94 sufficiently large enough to permit rotation of square second portion 44 of the axle within the aperture. Disc 76 has a similar sized circular central aperture 96.

A knob 98 has a threaded aperture 100 which in normal use is threaded onto the threaded portion 56 of bolt 52 projecting outwardly from the aperture 46 of the axle. The knob is turned to thread the knob onto bolt 52 and thus press together the friction discs between the knob and annular wall 102 of the cavity 58. The leather discs are compressed between the metal discs. The knob may be removed from the apparatus by unscrewing the knob from threaded portion 56 of bolt 52. Once, removed, the entire set of discs 70–78 can be removed and replaced.

The apparatus has a first cylindrical handle 104 connected to housing 2 by a U-shaped connector 106 formed by a metal rod. The handle 104 has a central aperture 108 received rotatably on outer straight portion 110 of the connector. The connector has side portions 112 and 114 which extend at right angles from the outer straight portion. A stub inner portion 116 extends at a right angle inwardly from side portion 112 and rotatably into aperture 118 in housing half 3. Side portion 114 has a similar stub inner portion 120 fitting rotatably within another aperture in the opposite end of housing half 3.

A second roller-shaped handle 122 is rotatably mounted on another U-shaped connecter 124. However, in this case, stub portions 126 and 128 of the connector fit within aperture 130 of the handle. The portion of the U-shaped connector 124 opposite handle 122 has a center bend 132 which tends to keep handle 122 centered relative to hook connector 30.

Figure 3:
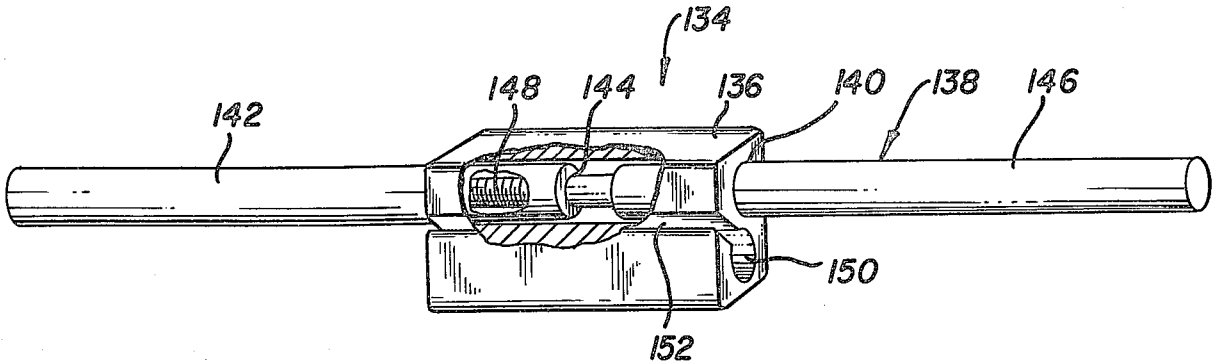
FIG. 3 is an isometric view of an elongate handle means for connecting to the apparatus; and, FIG. 4 is a side view of the apparatus connected to the elongate handle means.
Figure 4:
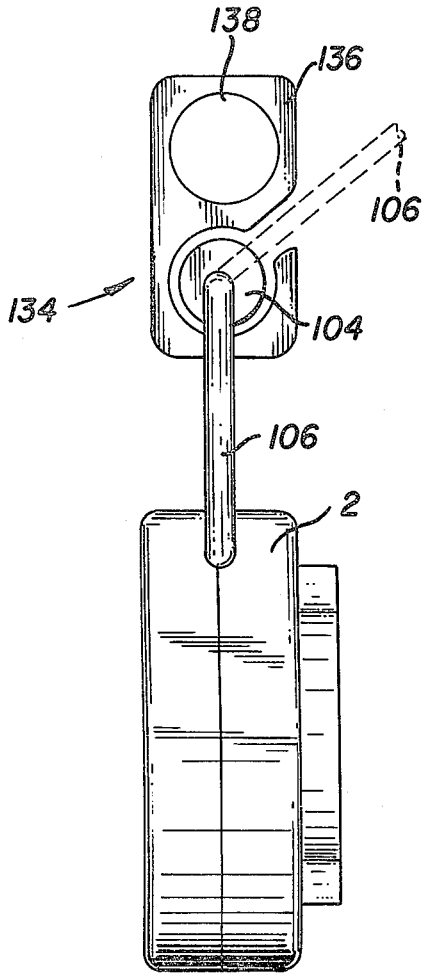

Optionally, the apparatus may include an elongate bar means 134 shown in FIGS. 3 and 4. The bar means has a fitting 136 for connecting the bar means to one of the handles 104 or 122. There is also an elongate bar 138 passing through longitudinal aperture 140 of the fitting. The bar 136 comprises a first portion 142 with a threaded aperture 144 and a second portion 146 with a threaded projection 148 threadedly received within aperture 144 of the first portion 142.

Fitting 136 has a second longitudinal aperture 150 parallel to elongate bar 138. Aperture 150 is of such a size to receive one of the handles 104 or 122. A slot 152 communicates outwardly from the aperture 150 and is shaped to allow clearance for connector 106 or 124 as one of the handles is slid into the fitting from one end of the elongate aperture. For example, handle 104 is shown received in the fitting in FIG.4.

Referring to FIG. 1, indicia in the form of dial 154 is inscribed on knob 98. The dial can be used to adjust the force of the friction discs with reference to a fixed indicia 156 on housing 2. The more the knob is tightened, the greater the friction and the greater the force necessary to pull strap 26 outwardly from the housing.

In order to obtain greater variation in the range of friction, the complete set of discs may be changed. For example, a smaller force is obtained by using another set of discs of smaller diameter. Alternatively, fewer discs may be used. Discs 76 and 78 could be omitted for example to provide a minimum set of three discs to provide some, though a reduced, frictional resistance. Alternatively, by using thinner discs more can be added to increase the force. Another leather disc such as disc 72, can be place over the shaft outwardly from disc 78, another center disc, such as disc 72, is then positioned followed by another leather disc and finally another outer disc such as disc 70. The knob 98 is then screwed back into position. Discs removed can be replaced by cardboard blanks which provide no significant frictional resistance. The complete set of discs may be removed to utilize the spring force only. This is usually sufficient for two handed exercises for women.

The exercising apparatus utilizes the frictional force between the friction discs to resist outward pulling of the strap 26 from the housing. After the strap is pulled out to the desired length, cam lock 48 permits spiral spring 16 to rotate pulley wheel 12 and rewind the strap onto the pulley wheel once the user stops exerting a force on the strap.

WHAT IS CLAIMED IS:

1. An exercising apparatus comprising:

(a) a hollow housing having an aperture extending therethrough and a cavity on one side, the cavity having a cylindrical central portion, the aperture communicating with the center of the cylindrical portion, and at least one slot portion extending outwardly at the edge of the central portion;

(b) a first handle means connected to the housing;

(c) an axle extending rotatably through the center of the housing, the axle having a first portion which is round in section, a second portion, which is square in section, extending through the cavity, and a longitudinal central aperture;

(d) bolt means extending through the aperture of the axle and having a threaded portion extending axially from the second portion;

(e) a pulley wheel within a hollow housing, the pulley wheel having a central aperture, the first portion of the axle extending through the aperture of the pulley wheel;

(f) one way clutch means between the pulley wheel and the first portion of the axle, the one way clutch means permitting free rotation of the pulley wheel in a first direction of rotation and locking the pulley to rotate with the axle in a second direction of rotation which is opposite the first direction;

(g) strap means connected to, and normally wound about, the pulley wheel, the strap means having a free end extending from an opening in the housing;

(h) a spiral spring within the hollow housing and connecting the housing and the pulley wheel to bias the pulley wheel in the first direction of rotation to wind the strap means on the pulley wheel;

(i) a set of at least three adjacent friction discs proportioned to fit freely and removeably within the cavity of the housing, a first non-rotatable metal disc having an outwardly extending projection shaped to fit within the slot portion of the cavity, a a rotatable metal disc with a square central aperture for receiving the second portion of the axle so the center disc rotates with the axle, and a first leather disc between the metal discs, each of the leather disc and the non-rotatable disc having a circular central aperture permitting rotation between said each disc and the axle; and, (j) knob means having a threaded aperture for threading the knob means onto the threaded portion of the bolt means, the friction discs being pressed together within the cavity between the knob means and the housing when the knob means is tightened on the bolt means, the knob means being removable from the bolt means to permit replacement of the set of friction discs.

2. An apparatus as claimed in claim 1, further comprising means on a free end of the strap means for connecting a second handle means to the apparatus.

3. An apparatus as claimed in claim 1, further comprising a second handle means connected to the free end of the strap means.

4. An apparatus as claimed in claim 2, further comprising an elongate bar means with a fitting for connecting the bar means to one of the handle means.

5. An apparatus as claimed in claim 4, wherein the one handle means has a cylindrical handle hingedly connected to the housing by a U-shaped connector and the bar means comprises an elongate bar extending from opposite sides of the fitting, the fitting having an elongate aperture parallel to the bar shaped for receiving the handle and a slot communicating outwardly from the aperture shaped to allow clearance for the connector as the one handle means is slid into the fitting from one end of the elongate aperture.

6. An apparatus as claimed in claim 1, wherein the knob means has a dial for indicating the force of the friction discs reisiting unwinding of the strap means.

7. An apparatus as claimed in claim 1, further comprising a second said leather disc on a side of the rotatable disc opposite the first leather disc and a second said non-rotatable metal disc on a side of the second leather disc opposite the rotatable disc.

* * * * *